US006954074B2

(12) United States Patent
Zhu et al.

(10) Patent No.: US 6,954,074 B2
(45) **Date of Patent: *Oct. 11, 2005**

(54) CIRCUIT FOR MEASURING IONIZATION CURRENT IN A COMBUSTION CHAMBER OF AN INTERNAL COMBUSTION ENGINE

(75) Inventors: Guoming G. Zhu, Novi, MI (US); Bruce Wang, Troy, MI (US); Kenneth L. Gould, Fayetteville, GA (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 61 days.

This patent is subject to a terminal disclaimer.

(21) Appl. No.: 10/458,705

(22) Filed: Jun. 11, 2003

(65) Prior Publication Data

US 2004/0085069 A1 May 6, 2004

Related U.S. Application Data

(60) Provisional application No. 60/423,044, filed on Nov. 1, 2002.

(51) Int. Cl.[7] ..... F02P 17/00
(52) U.S. Cl. ..... 324/399; 324/388
(58) Field of Search ..... 324/391, 380, 324/384, 388, 393, 399, 402; 73/35.08, 116; 123/654, 656

(56) References Cited

U.S. PATENT DOCUMENTS

| | | | | |
|---|---|---|---|---|
| 5,510,715 A | * | 4/1996 | Takeuchi | 324/391 |
| 5,548,220 A | | 8/1996 | Kawamoto et al. | 324/399 |
| 5,617,032 A | | 4/1997 | Inagaki | 324/399 |
| 5,652,520 A | | 7/1997 | Kawamoto et al. | 324/388 |
| 5,672,972 A | * | 9/1997 | McCoy et al. | 324/393 |
| 5,781,012 A | | 7/1998 | Yasuda | 324/399 |
| 5,861,551 A | | 1/1999 | Morita et al. | 73/116 |
| 5,914,604 A | | 6/1999 | Bahr et al. | 324/399 |
| 6,011,397 A | | 1/2000 | Yasuda | 324/388 |
| 6,054,860 A | | 4/2000 | Aoki et al. | 324/402 |
| 6,075,366 A | | 6/2000 | Yasuda | 324/380 |
| 6,104,195 A | | 8/2000 | Yoshinaga et al. | 324/459 |
| 6,118,276 A | | 9/2000 | Nakata et al. | 324/464 |
| 6,185,984 B1 | | 2/2001 | Takahashi | 73/35.08 |
| 6,186,129 B1 | | 2/2001 | Butler, Jr. | 123/620 |
| 6,196,054 B1 | | 3/2001 | Okamura et al. | 73/35.08 |
| 6,202,474 B1 | | 3/2001 | Takahashi et al. | 73/35.08 |
| 6,205,844 B1 | | 3/2001 | Morita et al. | 73/35.08 |
| 6,275,041 B1 | | 8/2001 | Okamura et al. | 324/380 |
| 6,336,355 B1 | | 1/2002 | Sasaki et al. | 73/35.08 |
| 2004/0084034 A1 | * | 5/2004 | Huberts et al. | 123/630 |
| 2004/0084036 A1 | * | 5/2004 | Porter et al. | 123/634 |
| 2004/0085070 A1 | * | 5/2004 | Daniels et al. | 324/391 |

FOREIGN PATENT DOCUMENTS

EP 0 305 347 A1 3/1989

* cited by examiner

*Primary Examiner*—Anjan Deb
(74) *Attorney, Agent, or Firm*—Dickinson Wright PLLC

(57) ABSTRACT

A circuit for measuring ionization current in a combustion chamber of an internal combustion engine including an ignition coil, having a primary winding and a secondary winding, and an ignition plug. The ignition plug ignites an air/fuel mixture in the combustion chamber and produces an ignition current in response to ignition voltage from the ignition coil. A capacitor, charged by the ignition coil, provides a bias voltage producing an ionization current after ignition of the air/fuel mixture in the combustion chamber. A current mirror circuit produces an isolated current signal proportional to the ionization current. In the present invention, the ignition current and the ionization current flow in the same direction through the secondary winding of the ignition coil. The charged capacitor operates as a power source and, thus, the ignition current flows from the charged capacitor through the current mirror circuit and the ignition coil to the ignition plug.

20 Claims, 2 Drawing Sheets

CIRCUIT FOR MEASURING IONIZATION CURRENT IN A COMBUSTION CHAMBER OF AN INTERNAL COMBUSTION ENGINE

CROSS-REFERENCE TO RELATED APPLICATION

This application claims benefit of U.S. Provisional Application Ser. No. 60/423,044, filed Nov. 1, 2002, the entire disclosure of this application being considered part of the disclosure of this application and hereby incorporated by reference.

BACKGROUND OF THE INVENTION

1. Technical Field

The present invention relates to a circuit for measuring ionization current in a combustion chamber of an internal combustion engine.

2. Discussion

An internal combustion engine produces power by compressing a fuel gas mixed with air in a combustion chamber with a piston and then igniting the mixed gas with an ignition or spark plug. When combustion of the mixed gas occurs in the combustion chamber, the gas is ionized. If, after combustion, a bias voltage is applied between the ignition plug electrodes, then an electric current is produced which passes through the chamber due to the ions generated during the combustion process. This electric current is commonly referred to as ionization current. Since the ionization current varies with respect to the characteristics of the combustion, measurement of the ionization current provides important diagnostic information regarding engine combustion performance.

Several circuits have been proposed for detecting ionization current, however these prior art detection circuits have several shortcomings. In prior art detection circuits, the ignition current (which is produced in response to the combustion of the mixed gas) and the ionization current flow in opposite directions through the secondary winding of the ignition coil, thus requiring the ionization current to overcome the stored energy in the secondary winding of the ignition coil before the ionization current can be detected. As a result, the initiation or, in other words, the flow of ionization current as well as the detection of ionization current is delayed in time. Further, in prior art detection circuits, the ionization current is detected by way of a current mirror circuit which requires a second power source other than the ignition coil. Typically, the second power source supplies a relatively low voltage (e.g. 1.4 volts) to the current mirror circuit. As a result, the magnitude of the mirrored current signal is relatively small and the signal-to-noise ratio is low. Even further, prior art detection circuit designs are complex and, therefore, costly. Accordingly, there is a desire to provide a circuit for measuring ionization current which overcomes the shortcomings of the prior art.

SUMMARY OF THE INVENTION

The present invention provides a circuit for measuring ionization current in a combustion chamber of an internal combustion engine including an ignition coil and an ignition plug. The ignition plug ignites an air/fuel mixture in the combustion chamber and produces an ignition current in response to ignition voltage from the ignition coil. A capacitor, charged by the ignition coil, provides a bias voltage which produces an ionization current after ignition of the air/fuel mixture in the combustion chamber. A current mirror circuit produces an isolated current signal proportional to the ionization current.

In one embodiment of the present invention, the ignition coil includes a primary winding and a secondary winding. The ignition current and the ionization current flow in the same direction through the secondary winding of the ignition coil. The ignition current flows from the charged capacitor through the current mirror circuit and the ignition coil to the ignition plug.

Further scope of applicability of the present invention will become apparent from the following detailed description, claims, and drawings. However, it should be understood that the detailed description and specific examples, while indicating preferred embodiments of the invention, are given by way of illustration only, since various changes and modifications within the spirit and scope of the invention will become apparent to those skilled in the art.

BRIEF DESCRIPTION OF THE DRAWINGS

The present invention will become more fully understood from the detailed description given here below, the appended claims, and the accompanying drawings in which:

DETAILED DESCRIPTION OF THE PREFERRED EMBODIMENT

Figure 1:
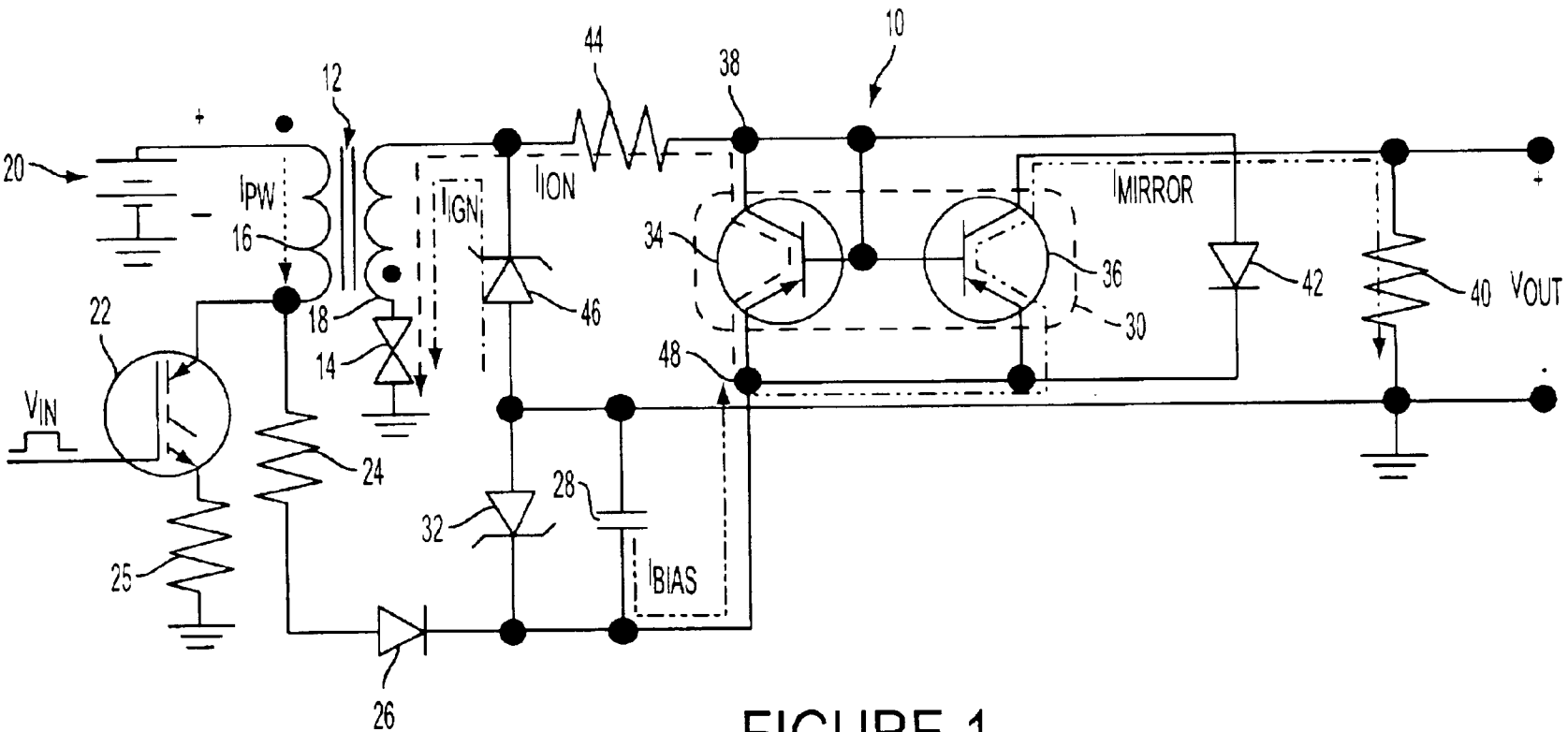
FIG. 1 is an electrical schematic of a circuit for measuring ionization current in a combustion chamber of an internal combustion engine in accordance with the present invention.

FIG. 1 is an electrical schematic of a circuit 10 for measuring ionization current in a combustion chamber of an internal combustion engine. The components and configuration of the circuit 10 are described first, followed by a description of the circuit operation.

First, with regard to the components and configuration of the present invention, the circuit 10 includes an ignition coil 12 and an ignition or spark plug 14 disposed in a combustion chamber of an internal combustion engine. The ignition coil 12 includes a primary winding 16 and a secondary winding 18. The ignition plug 14 is connected in electrical series between a first end of the secondary winding 18 and ground potential. The electrical connections to a second end of the secondary winding 18 are described further below. A first end of the primary winding 16 is electrically connected to a positive electrode of a battery 20. A second end of the primary winding 16 is electrically connected to the collector terminal of an insulated gate bipolar transistor (IGBT) or other type of transistor 22 and a first end of a first resistor 24. The base terminal of the IGBT 22 receives a control signal, labeled $V_{IN}$ in FIG. 1, from a powertrain control module (PCM) not shown. Control signal $V_{IN}$ gates IGBT 22 on and off. A second resistor 25 is electrically connected in series between the emitter terminal of the IGBT 22 and ground. A second end of the first resistor 24 is electrically connected to the anode of a first diode 26.

The circuit 10 further includes a capacitor 28. A first end of the capacitor 28 is electrically connected to the cathode of the first diode 26 and a current mirror circuit 30. A second end of the capacitor 28 is grounded. A first zener diode 32 is electrically connected across or, in other words, in parallel with the capacitor 28 with the cathode of the first zener diode 32 electrically connected to the first end of the capacitor 28 and the anode of the first zener diode 32 electrically connected to ground.

The current mirror circuit 30 includes first and second pnp transistors 34 and 36 respectively. The pnp transistors 34 and 36 are matched transistors. The emitter terminals of the pnp transistors 34 and 36 are electrically connected to the first end of the capacitor 28. The base terminals of the pnp transistors 34 and 36 are electrically connected to each other as well as a first node 38. The collector terminal of the first pnp transistor 34 is also electrically connected to the first node 38, whereby the collector terminal and the base terminal of the first pnp transistor 34 are shorted. Thus, the first pnp transistor 34 functions as a diode. A third resistor 40 is electrically connected in series between the collector terminal of the second pnp transistor 36 and ground.

A second diode 42 is also included in the circuit 10. The cathode of the second diode 42 is electrically connected to the first end of the capacitor 28, the emitter terminals of the first and second pnp transistors 34 and 36. The anode of the second diode 42 is electrically connected to the first node 38.

The circuit 10 also includes a fourth resistor 44. A first end of the fourth resistor 44 is electrically connected to the first node 38. A second end of the fourth resistor 44 is electrically connected to the second end of the secondary winding 18 (opposite the ignition plug 14) and the cathode of a second zener diode 46. The anode of the second zener diode 46 is grounded.

Figure 2A:
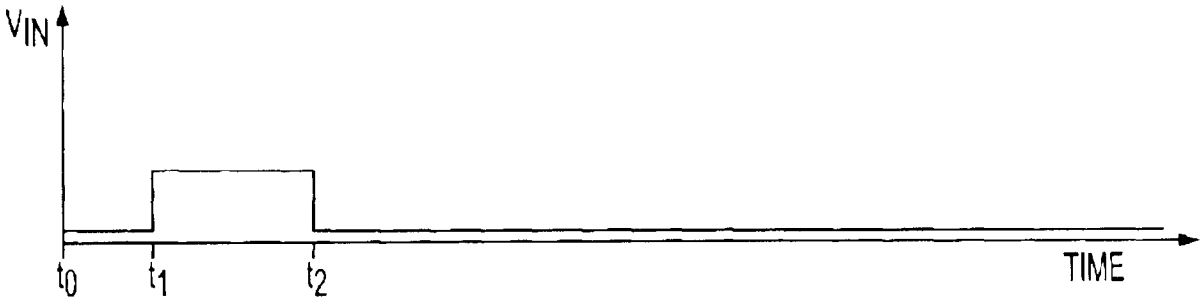
FIG. 2A is a graph of a control signal input to the circuit.
Figure 2B:
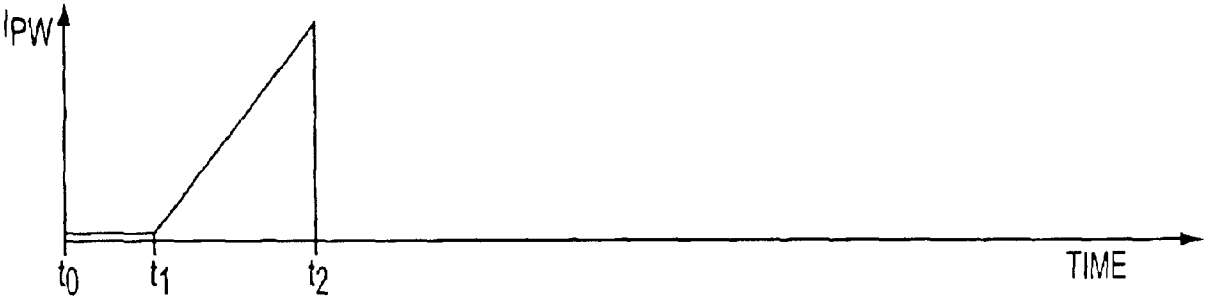
FIG. 2B is a graph of current flow through the primary winding of the ignition coil during circuit operation.
Figure 2C:
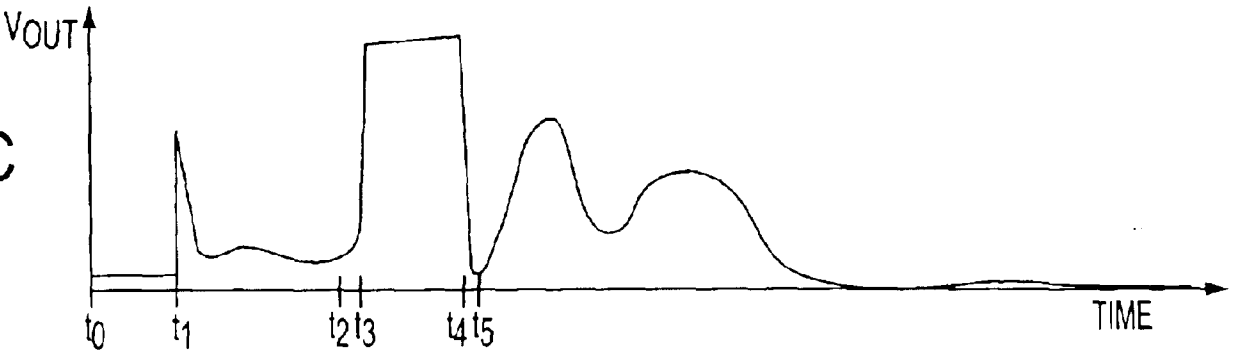
FIG. 2C is a graph of an output voltage signal from the circuit.

Referring now to FIGS. 1 and 2, the operation of the circuit 10 is described. FIG. 2A is a graph of the control signal $V_{IN}$ from the PCM to the IGBT 22 versus time. FIG. 2B is a graph of the current flow ($I_{PW}$) through the primary winding 16 of the ignition coil 12 versus time. FIG. 2C is a graph of an output voltage signal from the circuit 10 versus time. As mentioned above, the IGBT 22 receives the control signal $V_{IN}$ from the PCM to control the timing of 1) the ignition or combustion and 2) the charging of the capacitor 28. In this circuit configuration, the IGBT 22 is operated as a switch having an OFF, or non-conducting, state and an ON, or conducting, state.

Initially, at time=$t_0$, the capacitor 28 is not fully charged. The control signal $V_{IN}$ from the PCM is LOW (see FIG. 2A) thereby operating the IGBT 22 in the OFF, or non-conducting, state. Primary winding 16 sees an open circuit and, thus, no current flows through the winding 16.

At time=$t_1$, the control signal $V_{IN}$ from the PCM switches from LOW to HIGH (see FIG. 2A) thereby operating the IGBT 22 in the ON, or conducting, state. Current from the battery 20 begins to flow through the primary winding 16 of the ignition coil 12, the conducting IGBT 22, and the second resistor 25 to ground. Any of a number of switches or switching mechanisms can be used to conduct current through the primary winding 16. In a preferred embodiment IGBT 22 is used. Between time=$t_1$ and time=$t_2$, the primary winding current $I_{PW}$, (illustrated in FIG. 1 with a dotted line) begins to rise. The time period between time=$t_1$ and time=$t_2$ is approximately one millisecond which varies per type of ignition coil.

At time=$t_2$, the control signal $V_{IN}$ from the PCM switches from HIGH to LOW (see FIG. 2A) thereby operating the IGBT 22 in the OFF, or non-conducting, state. As the IGBT 22 is switched OFF, flyback voltage from the primary winding 16 of the ignition coil 12 begins to quickly charge the capacitor 28 up to the required bias voltage. Between time=$t_2$ and time=$t_3$, the voltage at the first end of the secondary winding 18 connected to the spark plug 14 rises to the voltage level at which the ignition begins. The time period between time=$t_2$ and time=$t_3$ is approximately ten microseconds. The first resistor 24 is used to limit the charge current to the capacitor 28. The resistance value of the first resistor 24 is selected to ensure that the capacitor 28 is fully charged when the flyback voltage is greater than the zener diode.

At time=$t_3$, an ignition voltage from the secondary winding 18 of the ignition coil 12 is applied to the ignition plug 14 and ignition begins. Between time=$t_3$ and time=$t_4$, combustion of the air/fuel mixture begins and an ignition current $I_{IGN}$ (illustrated in FIG. 1 with a dash-dot line) flows through the second zener diode 46, the secondary winding 18 of the ignition coil 12, and the ignition plug 14 to ground. At time=$t_4$, the ignition is completed and the combustion of the air/fuel mixture continues.

At time=$t_5$, the combustion process continues and the charged capacitor 28 applies a bias voltage across the electrodes of the ignition plug 14 producing an ionization current $I_{ION}$ due to the ions produced by the combustion process which flows from the capacitor 28. The current mirror circuit 30 produces an isolated mirror current $I_{MIRROR}$ identical to ionization current $I_{ION}$. A bias current $I_{BIAS}$ (illustrated in FIG. 1 with a phantom or long dash-short dash-short dash line) which flows from the capacitor 28 to the second node 48 is equal to the sum of the ionization current $I_{ION}$ and the isolated mirror current $I_{MIRROR}$ (i.e., $I_{BIAS}=I_{ION}+I_{MIRROR}$).

The ionization current $I_{ION}$ (illustrated in FIG. 1 with a dashed line) flows from the second node 48 through the first pnp transistor 34, the first node 38, the fourth resistor 44, the secondary winding 18 of the ignition coil 12, and the ignition plug 14 to ground. In this manner, the charged capacitor 28 is used as a power source to apply a bias voltage, of approximately 80 volts, across the spark plug 14 to generate the ionization current $I_{ION}$. The bias voltage is applied to the spark plug 14 through the secondary winding 18 and the fourth resistor 44. The secondary winding induction, the fourth resistor 44, and the effective capacitance of the ignition coil limit the ionization current bandwidth. Accordingly, the resistance value of the fourth resistor 44 is selected to maximize ionization signal bandwidth, optimize the frequency response, and also limit the ionization current. In one embodiment of the present invention, the fourth resistor 44 has a resistance value of 330 k ohms resulting in an ionization current bandwidth of up to twenty kilohertz.

The current mirror circuit 30 is used to isolate the detected ionization current $I_{ION}$ and the output circuit. The isolated mirror current $I_{MIRROR}$ (illustrated in FIG. 1 with a dash-dot-dot line) is equal to or, in other words, a mirror of the ionization current $I_{ION}$. The isolated mirror current $I_{MIRROR}$ flows from the second node 48 through the second pnp transistor 36 and the third resistor 40 to ground. To produce a isolated mirror current signal $I_{MIRROR}$ which is identically proportional to the ionization current $I_{ION}$, the first and second pnp transistors 34 and 36 must be matched, i.e., have the identical electronic characteristics. One way to achieve such identical characteristics is to use two transistors residing on the same piece of silicon. The isolated mirror current signal $I_{MIRROR}$ is typically less than 300 microamps. The third resistor 40 converts the isolated mirror current signal $I_{MIRROR}$ into a corresponding output voltage signal which is labeled as $V_{OUT}$ in FIG. 1. The resistance value of the third resistor 40 is selected to adjust the magnitude of the output voltage signal $V_{OUT}$. The second diode 42 protect the mirror transistor 34 and 36 by biasing on and providing a path to ground if the voltage at node 38 crossed a threshold. A third transistor can also be used to protect the mirror transistor.

FIG. 2C illustrates an output voltage signal $V_{OUT}$ resulting from a normal combustion event. The portion of the output voltage signal $V_{OUT}$ from time=$t_5$ and beyond can be used as diagnostic information regarding combustion performance. To determine the combustion performance for the entire engine, the ionization current in one or more combustion chambers of the engine can be measured by one or more circuits 10 respectively.

In the present circuit 10, the ignition current $I_{IGN}$ and the ionization current $T_{ION}$ flow in the same direction through the secondary winding 18 of the ignition coil 12. As a result, the initiation or, in other words, the flow of the ionization current as well as the detection of the ionization current is quick. In the present circuit 10, the charged capacitor 28 operates as a power source thus the circuit 10 is passive or, in other words, does not require a dedicated power source. The charged capacitor 28 provides a relatively high bias voltage from both ionization detection and the current mirror circuit 30. As a result, the magnitude of the mirrored, isolated current signal $I_{MIRROR}$ is large and, thus, the signal-to-noise ratio is high. Finally, the present circuit 10 is less complex and less expensive than prior art detection circuits.

The foregoing discussion discloses and describes an exemplary embodiment of the present invention. One skilled in the art will readily recognize from such discussion, and from the accompanying drawings and claims that various changes, modifications and variations can be made therein without departing from the true spirit and fair scope of the invention as defined by the following claims.

What is claimed is:

1. A method of measuring ionization current in a combustion chamber, comprising the steps of:

receiving a control signal;

generating a flyback voltage on a primary winding of an ignition coil;

charging a capacitor with said flyback voltage;

combusting an air/fuel mixture;

generating an ignition current, whereby said ignition current flows through a secondary winding of said ignition coil;

applying a bias voltage across an ignition plug through said secondary winding of said ignition coil to generate ionization current; and generating a mirror current proportional to said ionization current.

2. The method of measuring ionization current according to claim 1 wherein said ionization current flows in a same direction as said ignition current through said secondary winding of said ignition coil.

3. The method of measuring ionization current according to claim 2 further comprising the steps of:

isolating said ionization current;

converting said mirror current into an output voltage;

receiving said control signal from a powertrain control module;

limiting charge current to the capacitor; and maximizing ionization signal bandwidth and optimizing frequency response.

4. The method of measuring ionization current according to claim 1 further comprising the step of isolating said ionization current.

5. The method of measuring ionization current according to claim 1 further comprising the step of converting said mirror current into an output voltage.

6. The method of measuring ionization current according to claim 1 further comprising the step of receiving said control signal from a powertrain control module.

7. The method of measuring ionization current according to claim 1 further comprising the step of limiting charge current to the capacitor.

8. The method of measuring ionization current according to claim 1 further comprising the step of maximizing ionization signal bandwidth and optimizing frequency response.

9. A method of measuring ionization current in a combustion chamber comprising the steps of:

generating a flyback voltage on a primary winding of an ignition coil;

charging a capacitor with said flyback voltage;

applying a bias voltage across an ignition plug through a secondary winding of said ignition coil to generate ionization current; and generating a mirror current proportional to said ionization current.

10. An ionization detection circuit, comprising:

an ignition coil comprising a primary winding and a secondary winding;

a battery operably connected to a first end of said primary winding;

an ignition plug operably connected between a first end of said secondary winding and ground potential;

a capacitor having a first end operably connected to a second end of said primary winding;

a current mirror having a first terminal operably connected to a second end of said secondary winding and a second terminal operably connected to said first end of said capacitor; and a switch operably connected to said primary winding, wherein said capacitor is capable of being charged by a flyback voltage generated on said primary winding of said ignition coil.

11. The ionization detection circuit of claim 10 wherein said ignition plug ignites an air/fuel mixture in a combustion chamber and produces an ignition current in response to ignition voltage from said ignition coil; said capacitor provides a bias voltage producing an ionization current after ignition of said air/fuel mixture in said combustion chamber; and said current mirror produces an isolated mirror current proportional to said ionization current.

12. The ionization detection circuit of claim 11 wherein said ignition current and said ionization current flow in the same direction through said secondary winding of said ignition coil.

13. The ionization detection circuit of claim 11 wherein said ionization current flows from said charged capacitor through said current mirror and said secondary winding of said ignition coil to said ignition plug.

14. The ionization detection circuit according to claim 10 wherein said current mirror comprises a pair of matched transistors.

15. The ionization detection circuit according to claim 14 wherein each of said pair of matched transistors comprises a base terminal, a collector terminal and an emitter terminal, whereby said base terminals are operably connected to each other and said base terminals are operably connected to each other.

16. The ionization detection circuit according to claim 14 further comprising:

a first resistor operably connected between a third terminal of said current mirror and ground potential;

a second resistor operably connected between said switch and ground potential;

a third resistor operably connected between said first terminal of said current mirror and said second end of said secondary winding, whereby signal bandwidth is maximized and frequency response is optimized;

a fourth resistor operably connected between said first end of said capacitor and said second end of said primary winding;

a first diode operably connected in parallel with said capacitor; and a second diode operably connected between said a third terminal of said current mirror and said first end of said capacitor.

17. The ionization detection circuit according to claim 10 further comprising a resistor operably connected between a third terminal of said current mirror and ground potential.

18. The ionization detection circuit according to claim 10 further comprising a resistor operably connected between said first terminal of said current mirror and said second end of said secondary winding, whereby ionization signal bandwidth is maximized and frequency response is optimized.

19. The ionization detection circuit according to claim 10 further comprising a resistor operably connected between said first end of said capacitor and said second end of said primary winding.

20. The ionization detection circuit according to claim 10 further comprising a diode operably connected between said a third terminal of said current mirror and said first end of said capacitor.

* * * * *

UNITED STATES PATENT AND TRADEMARK OFFICE

CERTIFICATE OF CORRECTION

PATENT NO. : 6,954,074 B2
DATED : October 11, 2005
INVENTOR(S) : Guoming G. Zhu et al.

It is certified that error appears in the above-identified patent and that said Letters Patent is hereby corrected as shown below:

Column 5,
Line 12, "$T_{ION}$" should be -- $I_{ION}$ --.

Signed and Sealed this

Twenty-seventh Day of December, 2005

JON W. DUDAS
*Director of the United States Patent and Trademark Office*